US009422897B2

(12) United States Patent
Hoefner et al.

(10) Patent No.: US 9,422,897 B2
(45) Date of Patent: Aug. 23, 2016

(54) FUEL SYSTEM FOR AN INTERNAL COMBUSTION ENGINE

(71) Applicants: Robert Bosch GmbH, Stuttgart (DE); Audi AG, Ingolstadt (DE)

(72) Inventors: Dirk Hoefner, Wellheim (DE); Sven Troester, Neuburg an der Donau (DE); Bernd Schroeder, Esslingen (DE); Berthold Pfuhl, Markgroeningen (DE); Maximilian Stichlmeir, Ingolstadt (DE); Martin Laich, Murr (DE)

(73) Assignees: Robert Bosch GmbH, Stuttgart (DE); Audi AG, Ingolstadt (DE)

( * ) Notice: Subject to any disclaimer, the term of this patent is extended or adjusted under 35 U.S.C. 154(b) by 0 days.

(21) Appl. No.: 14/612,575

(22) Filed: Feb. 3, 2015

(65) Prior Publication Data

US 2015/0167604 A1 Jun. 18, 2015

Related U.S. Application Data

(63) Continuation of application No. 13/261,326, filed as application No. PCT/EP2011/059633 on Jun. 9, 2011, now Pat. No. 8,973,556.

(30) Foreign Application Priority Data

Jul. 6, 2010 (DE) ..... 10 2010 026 159

(51) Int. Cl.
*F02M 37/00* (2006.01)
*F02M 43/00* (2006.01)
(Continued)

(52) U.S. Cl.
CPC ..... *F02M 37/0047* (2013.01); *F02M 43/00* (2013.01); *F02M 53/00* (2013.01);
(Continued)

(58) Field of Classification Search
CPC ..... F02M 37/0047; F02M 37/0076; F02M 37/0082; F02M 37/04; F02M 37/08; F02M 63/0001; F02M 63/0265; F02M 21/0245; F02M 69/046
USPC ..... 123/299, 300, 431, 445, 448, 456, 495, 123/514; 417/366, 368
See application file for complete search history.

(56) References Cited

U.S. PATENT DOCUMENTS 5,273,017 A * 12/1993 Braun et al. ..... 123/506
5,537,980 A 7/1996 Yamamoto
(Continued)

FOREIGN PATENT DOCUMENTS

DE 19652831 6/1998
DE 102006018702 10/2007
(Continued)

OTHER PUBLICATIONS

International Search Report for Application No. PCT/EP2011/059633 dated Aug. 19, 2011 (English Translation and Original, 4 pages).

*Primary Examiner* — Lindsay Low
*Assistant Examiner* — Robert Werner
(74) *Attorney, Agent, or Firm* — Michael Best & Friedrich LLP

(57) ABSTRACT

In a fuel system of an internal combustion engine, a low-pressure delivery unit for the fuel, at least indirectly delivers fuel to at least one low-pressure injection device. The fuel system further provides a high-pressure delivery unit, which has a drive region and a delivery region and at least indirectly delivers fuel to at least one high-pressure injection device. According to the invention, the fuel is first delivered by the low-pressure delivery unit to the drive region of the high-pressure delivery unit and from there onward to the low-pressure injection device and/or to the delivery region of the high-pressure delivery unit.

21 Claims, 1 Drawing Sheet

(51) Int. Cl.

| | |
|---|---|
| ***F02M 53/00*** | (2006.01) |
| ***F02M 59/00*** | (2006.01) |
| ***F02M 63/00*** | (2006.01) |
| ***F02M 69/04*** | (2006.01) |
| *F02M 21/02* | (2006.01) |
| *F02M 63/02* | (2006.01) |

(52) U.S. Cl.
CPC ..... *F02M 59/00* (2013.01); *F02M 63/0001* (2013.01); *F02M 69/046* (2013.01); *F02M 21/0212* (2013.01); *F02M 21/0245* (2013.01); *F02M 63/029* (2013.01)

(56) References Cited

U.S. PATENT DOCUMENTS

| | | | | |
|---|---|---|---|---|
| 5,642,716 | A | 7/1997 | Ricco | |
| 6,016,786 | A * | 1/2000 | Rodriquez-Amaya et al. | 123/299 |
| 6,021,761 | A | 2/2000 | Kellner et al. | |
| 6,196,191 | B1 | 3/2001 | Rembold et al. | |
| 6,609,500 | B2 * | 8/2003 | Ricco et al. | 123/446 |
| 7,007,662 | B2 | 3/2006 | Sakai et al. | |
| 7,178,506 | B2 | 2/2007 | Kojima et al. | |
| 7,341,043 | B2 * | 3/2008 | Kurata et al. | 123/431 |
| 7,380,539 | B2 | 6/2008 | Akita et al. | |
| 9,145,860 | B2 * | 9/2015 | Usui | F02M 59/462 |
| 2005/0268889 | A1 | 12/2005 | Kojima et al. | |
| 2005/0274353 | A1 | 12/2005 | Okubo et al. | |
| 2010/0252004 | A1 | 10/2010 | Miersch-Wiemers | |

FOREIGN PATENT DOCUMENTS

| | | |
|---|---|---|
| JP | 11280604 | 10/1999 |
| JP | 2000274329 | 10/2000 |
| JP | 2001506346 | 5/2001 |
| JP | 2006177336 | 7/2006 |

* cited by examiner

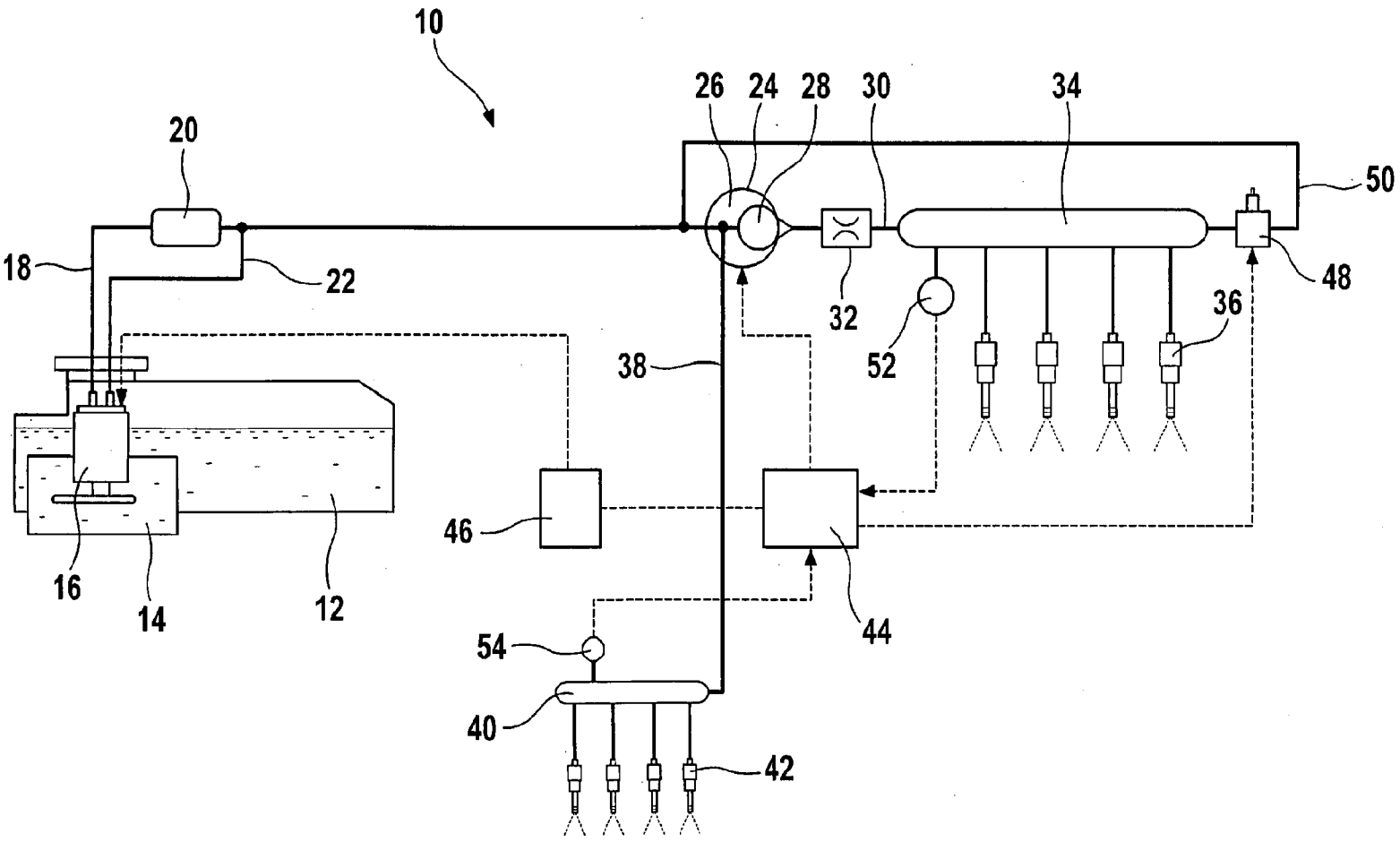
10
12
14
16
18
20
22
24
26
28
30
32
34
36
38
40
42
44
46
48
50
52
54

FUEL SYSTEM FOR AN INTERNAL COMBUSTION ENGINE

CROSS-REFERENCE TO RELATED APPLICATION

This application is a continuation of U.S. patent application Ser. No. 13/261,326, filed Jun. 14, 2012, which is a 35 USC 371 application of PCT/EP 2011/059633 filed on Jun. 9, 2011, the entire contents of each of which is incorporated herein in its entirety.

BACKGROUND OF THE INVENTION

1. Field of the Invention

The invention relates to a fuel system for an internal combustion engine.

2. Description of the Prior Art

German patent disclosure DE 10 2007 000 878 A1 describes a fuel system for an internal combustion engine in which the fuel can be injected both into an intake tube by means of a low-pressure injection valve and directly into a combustion chamber of the engine by means of a high-pressure injection valve. To that end, a low-pressure delivery unit delivers the fuel from a fuel tank both to the low-pressure injection valves and to a high-pressure delivery unit, which delivers the fuel onward into a high-pressure rail and from there to the high-pressure injection valves.

ADVANTAGES AND SUMMARY OF THE INVENTION

The advantage of the fuel system of the invention is that the fuel, delivered by the low-pressure delivery unit, flows constantly through the high-pressure delivery unit. As a result, the mechanical parts of the high-pressure delivery unit are cooled and lubricated, even if the high-pressure delivery unit itself is delivering only little, if any, fuel to the high-pressure injection valve. The service life and operating reliability of the high-pressure delivery unit are improved as a result. In particular, the especially grave case of a delivery element of the high-pressure delivery unit that seizes from a lack of lubrication and cooling is reliably averted. Uncoupling the high-pressure delivery unit, which is technically complicated, can also be avoided; that is, the high-pressure delivery unit can always "keep running". This is especially advantageous when the high-pressure delivery unit is driven mechanically, for instance by a camshaft of the engine. A high-pressure delivery unit that keeps running constantly furthermore has the advantage that a high pressure downstream of the high-pressure delivery unit is always available, so that upon a corresponding change of types of operation, fuel at high pressure can immediately be injected, and so that the high-pressure injection valves can be permanently subjected via the high-pressure rail to a certain pressure, as a result of which, for so-called "holding-down elements" (such as a valve spring) of the high-pressure injection valves, a more-favorable design with regard to the holding-down force can be chosen.

In a first preferred refinement of the fuel system of the invention, the drive region includes a recess in a housing, in which recess a drive shaft and/or at least one delivery element, in particular a delivery piston, is disposed. Because low-pressure fuel flows through it or is flushed through it, this kind of drive region is cooled and lubricated especially reliably.

It is also advantageous if the high-pressure delivery unit includes a quantity control valve. For instance, with such a quantity control valve, an inlet valve of the high-pressure delivery unit, whenever the latter is a piston pump, can be put into the open position in compulsory fashion. The fuel quantity to be delivered can be adjusted by way of the length of time during which the inlet valve is open during a delivery stroke of the high-pressure delivery unit. In particular whenever the inlet valve is forced constantly into the open position, or in other words whenever no fuel at all is being delivered by the high-pressure delivery unit to the high-pressure injection valve, effective cooling and lubrication of the drive region is ensured by the provision according to the invention of the flushing of the drive region of the high-pressure delivery unit.

It is also proposed that the low-pressure delivery unit includes an electrically driven fuel pump. With such a pump, the fuel required for lubricating and cooling the drive region of the high-pressure delivery unit can be reliably furnished. An electrically driven fuel pump of this kind can for instance be disposed directly in the fuel tank, which makes especially efficient operation possible. A typical system pressure that can be furnished by the low-pressure delivery unit is in the range of 0.05 to 0.74 MPa, and in other cases is also approximately 1.00 MPa.

A further advantageous embodiment of the fuel system of the invention is distinguished in that the delivery output of the electric fuel pump is variable. This makes it possible to respond not only to a varying fuel demand from the engine but also to a variable demand for lubrication and cooling of the drive region of the high-pressure delivery unit. This saves fuel, since it avoids an unnecessarily high delivery output by the electric fuel pump.

A low-pressure rail can be disposed fluidically between the drive region of the high-pressure delivery unit and the low-pressure injection valve. It is then possible for a plurality of low-pressure injection valves, which inject the fuel into corresponding intake tubes, for instance, of respective cylinders of the engine, to be connected to one such low-pressure rail. Such a low-pressure rail creates a buffer reservoir for the fuel, and this reservoir evens out pressure pulsations.

The situation is also similar for the refinement in which a high-pressure rail is disposed fluidically between the delivery region of the high-pressure delivery unit and the high-pressure injection valve. In that case, a plurality of high-pressure injection valves, which for instance inject the fuel directly into respective combustion chambers assigned to them, can be connected to the high-pressure rail.

Advantageously, the fuel system is embodied for operation of the internal combustion engine with CNG, LPG, and/or MPI. CNG stands for "compressed natural gas" and thus allows engine operation using natural gas. LPG stands for "liquid petrol gas"; thus the engine can then be operated with special automobile gas. MPI stands for "multipoint injection" and means that the fuel is injected at various sites of the engine, such as into the intake tube, directly into the combustion chamber, or into both the intake tube and the combustion chamber simultaneously.

BRIEF DESCRIPTION OF THE DRAWINGS

Below, one embodiment of the present invention is described as an example, in conjunction with the sole drawing FIGURE.

DESCRIPTION OF THE PREFERRED EMBODIMENT

A fuel system for an internal combustion engine is identified overall in FIG. 1 by reference numeral 10. It includes a fuel container 12, in which a tank unit 14 is disposed. The latter in turn includes a low-pressure delivery unit 16 in the form of an electric fuel pump.

The low-pressure delivery unit 16 delivers the fuel into a low-pressure fuel line 18, in which a filter 20 is disposed. Downstream of the filter 20, a return line 22 leads back to the low-pressure delivery unit 16. A pressure regulating or pressure limiting valve, which adjusts the pressure in the low-pressure fuel line 18 to a certain pressure, can be disposed in the return line 22. However, this valve is not shown.

The low-pressure fuel line 18 leads to a high-pressure delivery unit 24, in the form of a piston pump mechanically driven by the engine. The high-pressure delivery unit 24 includes a drive region 26 and a delivery region 28. The drive region 26 includes a recess, not shown, in a housing, not identified by reference numeral in FIG. 1, of the high-pressure delivery unit 24, in which unit a drive shaft and a delivery element, such as a delivery piston, are disposed. The drive shaft is an eccentric shaft, for instance, which in turn is driven mechanically by the engine. This drive shaft is supported in the housing via suitable bearings.

The delivery region 28 includes an inlet valve, a delivery chamber, and an outlet valve (not shown in the drawing). Via the inlet valve, the fuel is aspirated from the low-pressure fuel line 18 and the drive region 26 into the delivery chamber, is compressed via the piston in the delivery chamber, and is expelled via the outlet valve into a high-pressure fuel line 30. This latter line leads via a throttle restriction 32 to a high-pressure rail 34, to which a plurality of high-pressure injection valves 36 are connected.

As noted, the low-pressure fuel line 18 leads into the drive region 26, and in particular into the recess in the drive region 26, in which recess the drive shaft and the delivery element are disposed. From there, not only does the fuel reach the inlet valve of the delivery region 28 of the high-pressure delivery unit 24, but it also, via a second low-pressure fuel line 38, reaches a low-pressure rail 40. Four low-pressure injection valves 42 are connected to this low-pressure rail.

The operation of the fuel system 10 is controlled and regulated by an electronic control and regulating device 44. For example, the control and regulating device 44 communicates with the low-pressure delivery unit 16 via a power end stage 46, making it possible to vary the delivery output of the low-pressure delivery unit. The control and regulating device 44 furthermore controls a quantity control valve, again not shown in the drawing. This is for instance an electromagnetic actuation device, by which the inlet valve of the delivery region 28 of the high-pressure delivery unit 24 can be kept open in compulsory fashion. The delivery output of the high-pressure delivery unit 24 can be varied by way of the length of time during which the inlet valve is kept open in compulsory fashion during a delivery stroke of the high-pressure delivery unit 24. If no fuel whatever is to be delivered by the high-pressure delivery unit 24 into the high-pressure rail 34, then the inlet valve is forced constantly into the open position, for example.

In addition, a pressure limiting valve 48, which can connect the high-pressure rail 34 to the low-pressure fuel line 18 via a return line 50, is controlled by the control and regulating device 44. In this way, the pressure in the high-pressure rail 34 can be lowered. The control and regulating device 44 receives signals from various sensors, for instance from a pressure sensor 52 that detects the pressure in the high-pressure rail 34 and from a pressure sensor 54 that detects the pressure in the low-pressure rail 40. The corresponding measurement and control lines are represented in FIG. 1 by dashed lines.

The fuel system 10 functions as follows: From the low-pressure delivery unit 16, the fuel is delivered into the low-pressure fuel line 18. From there, the fuel reaches the drive region 26 of the high-pressure delivery unit 24, and as a result the moving parts located there are lubricated and the entire drive region 26 is cooled. From the drive region 26, the fuel on the one hand reaches the second low-pressure fuel line 38 and from there it goes on to the low-pressure rail 40, from which it is injected via the low-pressure injection valves 42, for instance into intake tubes of respective cylinders of the engine. On the other hand, the fuel is also delivered from the high-pressure delivery unit 24 into the high-pressure rail 34 and via the high-pressure injection valves 36 directly into the cylinders of the engine. Because the fuel is first carried through the drive region 26 and only after that is it carried onward to the low-pressure injection valves 42, reliable lubrication and cooling of the drive region 26 of the high-pressure delivery unit 24 is ensured, even whenever the high-pressure delivery unit 24 just at that moment, because of triggering of the quantity control valve accordingly, is not delivering any fuel at all, or is delivering only very little fuel. This is especially advantageous in MPI operation, or in other words multipoint injection operation.

The foregoing relates to the preferred exemplary embodiment of the invention, it being understood that other variants and embodiments thereof are possible within the spirit and scope of the invention, the latter being defined by the appended claims.

What is claimed is:

1. A fuel system for an internal combustion engine, having a low-pressure delivery unit which delivers fuel from a fuel tank at least indirectly to at least one low-pressure injection valve and having a high-pressure delivery unit for the fuel which has a drive region and a delivery region configured to deliver fuel at least indirectly to at least one high-pressure injection valve, wherein the low-pressure delivery unit is configured to deliver fuel first to the drive region of the high-pressure delivery unit and from there directly to the at least one low-pressure injection valve without passing through the low-pressure delivery unit a second time, even if the high-pressure delivery unit itself does not deliver fuel to the at least one high-pressure injection valve.

2. The fuel system as defined by claim 1, wherein the drive region includes a recess in a housing, in which recess a drive shaft and/or at least one delivery element is disposed.

3. The fuel system as defined by claim 1, wherein the high-pressure delivery unit includes a quantity control valve.

4. The fuel system as defined by claim 2, wherein the high-pressure delivery unit includes a quantity control valve.

5. The fuel system as defined by claim 1, wherein the low-pressure delivery unit includes an electric fuel pump.

6. The fuel system as defined by claim 4, wherein the low-pressure delivery unit includes an electric fuel pump.

7. The fuel system as defined by claim 5, wherein electric fuel pump is disposed in a fuel tank.

8. The fuel system as defined by claim 6, wherein electric fuel pump is disposed in a fuel tank.

9. The fuel system as defined by claim 5, wherein the delivery output of the electric fuel pump is variable.

10. The fuel system as defined by claim 6, wherein the delivery output of the electric fuel pump is variable.

11. The fuel system as defined by claim 7, wherein the delivery output of the electric fuel pump is variable.

12. The fuel system as defined by claim 8, wherein the delivery output of the electric fuel pump is variable.

13. The fuel system as defined by claim 1, wherein a low-pressure rail is disposed fluidically between the drive region of the high-pressure delivery unit and the at least one low-pressure injection valve.

14. The fuel system as defined by claim 2, wherein a low-pressure rail is disposed fluidically between the drive region of the high-pressure delivery unit and the at least one low-pressure injection valve.

15. The fuel system as defined by claim 6, wherein a low-pressure rail is disposed fluidically between the drive region of the high-pressure delivery unit and the at least one low-pressure injection valve.

16. The fuel system as defined by claim 1, wherein a high-pressure rail is disposed fluidically between the delivery region of the high-pressure delivery unit and the at least one high-pressure injection valve.

17. The fuel system as defined by claim 2, wherein a high-pressure rail is disposed fluidically between the delivery region of the high-pressure delivery unit and the at least one high-pressure injection valve.

18. The fuel system as defined by claim 6, wherein a high-pressure rail is disposed fluidically between the delivery region of the high-pressure delivery unit and the at least one high-pressure injection valve.

19. The fuel system as defined by claim 1, wherein the system is embodied for operation of the internal combustion engine with compressed natural gas, liquid petrol gas, and/or multipoint injection.

20. The fuel system as defined by claim 12, wherein the system is embodied for operation of the internal combustion engine with compressed natural gas, liquid petrol gas, and/or multipoint injection.

21. The fuel system as defined by claim 1, wherein the low-pressure delivery unit is configured to deliver fuel first to the drive region of the high-pressure delivery unit and from there directly to the at least one low-pressure injection valve without passing through the fuel tank, even if the high-pressure delivery unit itself does not deliver fuel to the at least one high-pressure injection valve.

* * * * *